US005257519A

United States Patent [19]

Miller, III

[11] Patent Number: 5,257,519

[45] Date of Patent: Nov. 2, 1993

[54] DEAD BOLT ASSEMBLY FOR COMBINATION DIAL LOCK ASSEMBLY

[76] Inventor: J. Clayton Miller, III, 5085 Danville Rd., Nicholasville, Ky. 40356

[21] Appl. No.: 867,550

[22] Filed: Apr. 13, 1992

[51] Int. Cl.[5] ..... E05B 37/05

[52] U.S. Cl. ..... 70/303 A; 70/443; 70/444; 70/467; 70/150; 70/326

[58] Field of Search ..... 70/303 A, 303 R, 443, 70/444, 467, 483, 150, 322, 317, 318, 326

[56] References Cited

U.S. PATENT DOCUMENTS

| | | | |
|---|---|---|---|
| 907,038 | 12/1908 | Greene | 70/303 R |
| 929,712 | 8/1909 | Runkle | 70/303 R |
| 1,040,764 | 10/1912 | Rose . | |
| 1,508,029 | 9/1924 | Segal | 292/150 |
| 1,510,562 | 10/1924 | Segal | 292/150 |
| 3,991,596 | 11/1976 | Gartner | 70/322 |
| 4,275,576 | 6/1981 | Miller | 70/322 |

OTHER PUBLICATIONS

Sargent & Greenleaf Catalog, published Jun., 1989, pp. 5 and 2.5–2.8.

*Primary Examiner*—Peter M. Cuomo
*Assistant Examiner*—Darnell M. Boucher
*Attorney, Agent, or Firm*—Lowe, Price, LeBlanc & Becker

[57] ABSTRACT

A dead bolt assembly for use with a combination dial lock assembly includes a housing structure adapted to receive a combination dial lock assembly. The housing structure includes a bolt hold back assembly which prevents extension of a dead bolt into a door strike. The bolt hold back assembly is operable from the inside of the door preventing manipulation of the combination dial on the outside of the door. Arranging the bolt hold back assembly in the housing permits ease of replacement and/or repair of standard or off the shelf type combination locks with the dead bolt assembly. The dead bolt assembly also includes a spring loaded pin arrangement which avoids a lockout situation. The housing structure includes a slot in the back plate which facilitates installation and/or removal of a combination dial lock assembly by permitting the lock shaft to slide into the housing structure without requiring removal of the combination dial or lock casing.

16 Claims, 8 Drawing Sheets

DEAD BOLT ASSEMBLY FOR COMBINATION DIAL LOCK ASSEMBLY

FIELD OF THE INVENTION

The present invention relates generally to a dead bolt assembly for a combination dial lock, and more particularly to dead bolt assemblies adapted to receive various combination dial locks. The invention further relates to prevention of a lock-out condition of the combination dial lock.

BACKGROUND OF THE INVENTION

In the prior art, combination dial dead bolt assemblies for use in doors accessing secured areas are known. Typically, these assemblies include a combination dial arranged on the outside of the door accessing the secured area. A shaft extends through the door to permit the combination dial to operate the lock and dead bolt assembly arranged on the inside of the door. Typically, in closing of the door, depression of the plunger by the strike activates and extends the bolt in the locked position.

These types of lock assemblies include a knob which may retract the dead bolt in a door strike from the inside of the secured area.

In order to prevent manipulation of the combination dial and inadvertent locking of the dead bolt from the outside of the secured area, prior art combination dial lock assemblies include a blocking feature accessible from the inside of the secured area to prevent unauthorized manipulation of the combination dial and locking of the dead bolt from the outside. In use, these devices permit a person in the secured area to block the locking device to lock the dead bolt in a retracted position thus preventing manipulation of the combination dial.

These prior art locking features are integral parts of the combination dial lock assembly.

Disadvantages associated with these prior art devices include the necessity of removal of the entire combination dial lock assembly to service the locking feature or lock if a malfunction occurs. Moreover, since the blocking feature is integrally made a part of the combination dial lock assembly, the combination dial lock assembly components cannot be replaced with other types or makes of combination dial locks since a combination dial lock having the blocking feature to hold the bolt in a retracted position includes special components associated therewith.

Another deficiency in prior art dead bolt assemblies includes occurrence of lockouts wherein the combination lock lever hangs in the up position against the lever stop resulting in binding of the dead bolt and lock malfunction.

As such, a need has developed to provide an improved combination dial dead bolt assembly which overcomes the deficiencies mentioned above in prior art devices.

The present invention provides an improved dead bolt assembly for a combination dial lock assembly which overcomes the disadvantages noted with prior art devices. In particular, the present invention provides a dead bolt assembly which permits locking a dead bolt assembly in a retracted position with the capability of using the inventive dead bolt assembly with different types and manufacture of combination dial lock assemblies. The present invention also includes features that avoid the occurrences of lockouts wherein a combination lock lever is stuck in an up position as a result of a force being applied against a combination lock dead bolt.

OBJECTS OF THE INVENTION

It is accordingly a first object of the present invention to provide a dead bolt assembly which is adapted for use with a combination dial lock assembly.

It is a further object of the present invention to provide a dead bolt assembly which is adapted for use with different types and makes of combination dial lock assemblies in combination with the inventive dead bolt assembly.

It is another object of the present invention to provide a dead bolt assembly which includes a bolt hold back feature which interacts with the dead bolt assembly independent from the combination dial lock assembly.

Other objects and advantages of the foregoing invention will be apparent as the description thereof proceeds.

In satisfaction of the foregoing objects and advantages, there is provided a dead bolt assembly for use with a combination lock assembly which in one embodiment includes an L-shaped member, a back plate, a bottom elongated member and a cover arranged over one leg of the L-shaped member and adjacent a portion of the bottom elongated member. The cover and portions of the back plate, bottom elongated member and L-shaped member form a channel for operation of a dead bolt. In another embodiment, the L-shaped member, back and bottom elongated member are formed as an integral or single component.

The dead bolt assembly includes a dead bolt carrier adapted to connect via a lever stop to the working components of a combination dial lock assembly. Aligned with the dead bolt carrier is a dead bolt which may extend into the strike of a door to secure a door in a locked position.

The L-shaped member of the dead bolt assembly includes a bolt hold back assembly which functions to prevent extension of the dead bolt by action of the dead bolt carrier. By arranging the bolt hold back assembly in the L-shaped member, any type or make of combination dial lock assembly may be utilized with the inventive dead bolt assembly.

The dead bolt assembly also includes a dead bolt turning mechanism which operates the dead bolt independently of the dead bolt carrier.

The back plate includes a slot therein which further facilitates removal or installation of a combination dial lock assembly into the dead bolt assembly.

In another aspect of the present invention, the L-shaped member and dead bolt include features which bias the dead bolt outwardly. In this arrangement, any forces applied to the end face of the dead bolt are transmitted to the L-shaped member rather than the combination dial lock assembly. The L-shaped member has a reduced thickness portion which forms one face of the channel. A slot in the reduced thickness portion is designed to receive a spring loaded pin extending outwardly from a rear face of the dead bolt. The spring contacts a closed face end of the slot to bias the dead bolt outwardly, the closed end of the slot also receiving any force applied to the end face of the bolt.

BRIEF DESCRIPTION OF DRAWINGS

Reference is now made to the Drawings accompanying the application wherein.

DESCRIPTION OF THE PREFERRED EMBODIMENTS

The present invention relates to a dead bolt assembly for use with combination dial lock assemblies. The inventive dead bolt assembly has significant features which provide improvements over other prior art combination lock and dead bolt assemblies.

First, the inventive dead bolt assembly includes features which are separate from a combination dial lock assembly which function in concert with the dead bolt travel. Since these features are independent of the combination dial lock assembly, any type of combination dial lock assembly may be utilized with the present invention.

In another aspect of the dead bolt assembly, occurrences of lockout wherein the combination dial lock lever hangs in the up position are avoided by the elimination of spring tension on the combination lock bolt and the lock lever arrangement.

In a further aspect of the present invention, the dead bolt assembly includes a back plate having a slot therein which facilitates removal of the combination dial lock after the lever and attaching screws have been removed.

Figure 1:
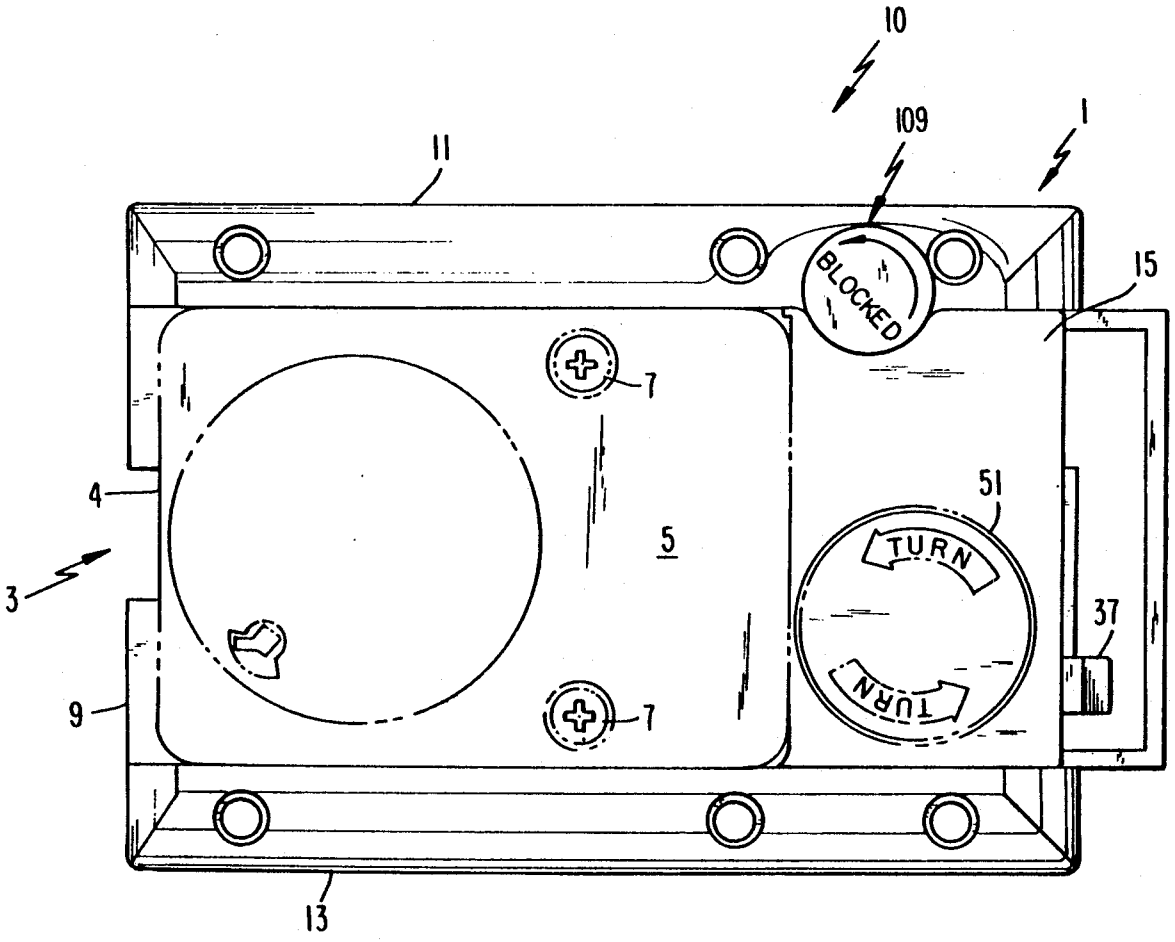
FIG. 1 shows a front view of the inventive dead bolt assembly.

With reference to FIG. 1, the inventive dead bolt assembly is generally designated by the reference numeral 10 and is seen to include a housing assembly 1 which houses a combination dial lock assembly 3. Although not shown, the combination dial lock assembly includes a shaft extending outwardly and having a combination dial attached to the distal end thereof. In a typical use, the combination dial seats against the outside of a door with the shaft extending therethrough to the combination dial lock assembly 3 arranged on the inside of the door.

The combination dial lock assembly includes a cover 5 which is attached to the combination dial lock casing 4 by fasteners 7. Removal of the cover 5 permits access to the components of the combination dial lock assembly.

With reference now to FIGS. 1 and 3*a*–3*c*, the housing assembly 1 includes a back plate 9, an L-shaped member 11, a bottom member 13 and a cover 15.

Figure 3A:
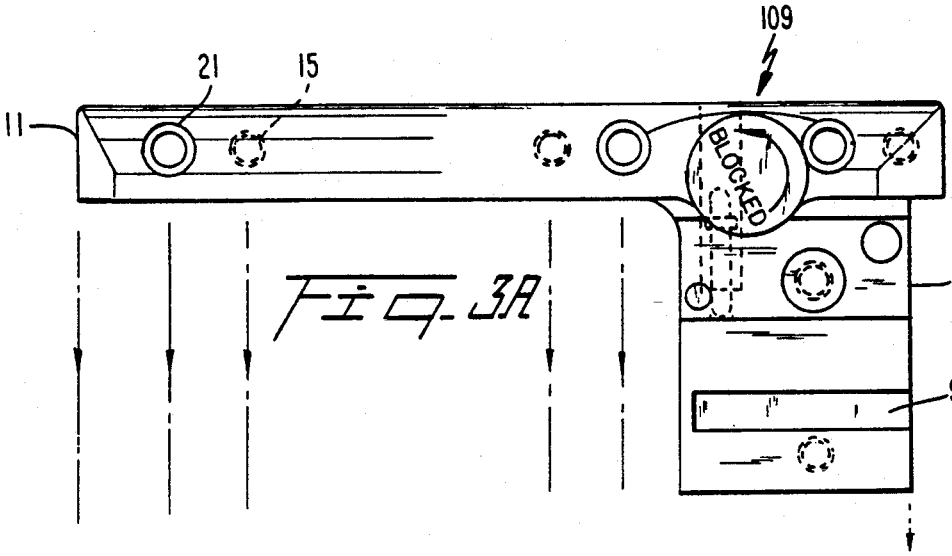
FIG. 3*a*–3*c* show a exploded view of the back plate, bottom member and L-shaped member of the inventive dead bolt assembly.
Figure 3B:
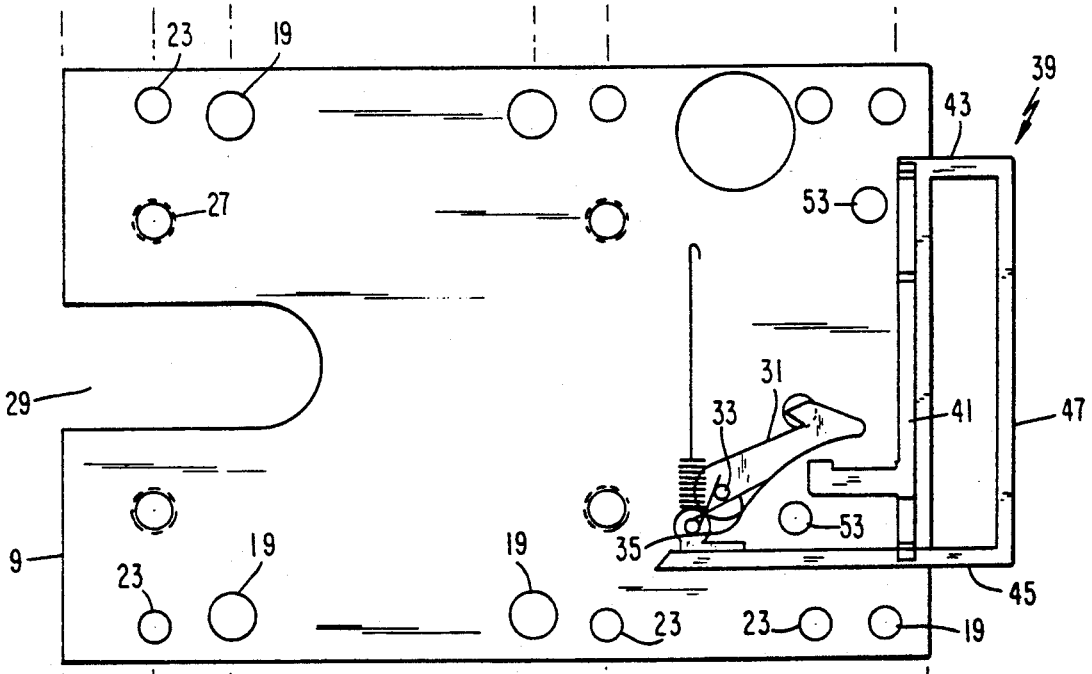
Figure 3C:
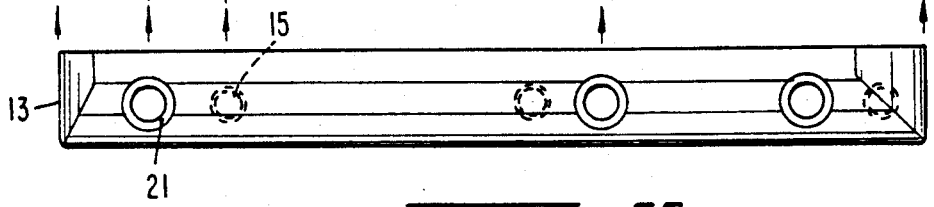

With reference to FIG. 3*c* and FIG. 1, the bottom member 13 includes openings 15 in the bottom surface 17 which permit attachment to the back plate 9 via the openings 19 therein. The bottom member 13 may be secured to the back member using any known types of fasteners (not shown) extending through the openings 19 into the threaded openings 15 and the bottom member 13. Openings 21 in the bottom member 13 are aligned with openings 23 in the back plate 9 to facilitate attachment of the inventive dead bolt assembly to a door surface (not shown).

In a similar manner, L-shaped member 11 includes the same number and configuration of openings therein to align with the openings in the back plate 9 to permit attachment between the L-shaped member 11 and back plate 9 and to a door surface.

As will be described hereinafter, the L-shaped member 11 has a leg 25 which forms in part a guide for dead bolt action of the inventive device.

The back plate 9 includes a plurality of spaced apart openings 27 which facilitate attachment of a combination dial lock assembly thereto. The back plate 9 also includes an open-ended slot 29 which is designed to receive the shaft of the combination dial lock assembly. The open-ended slot 29 permits the shaft of the combination dial lock assembly to slide into the back plate 9 to facilitate easy removal or installation of the combination dial lock assembly with the inventive dead bolt assembly.

The back plate 9, L-shaped member 11, bottom member 13 and cover 15 may be formed as a one piece integral structure such as a cast component. In this manner, manufacturing is simplified and production costs are lowered.

It should be understood that the combination dial lock assembly is not considered an aspect of the present invention. These types of lock assemblies are well known in the art and further detail as to the specific components and locking mechanisms associated therewith is not included.

The back plate 9 also includes a lever 31 mounted on a pin 33. The lever 31 is biased upwardly by the spring 35. As will be described hereinafter, the lever 31 cooperates with the plunger 37, see FIG. 1, during dead bolt operation of the inventive dead bolt assembly.

The back plate 9 includes a frame 39 attached thereto. The frame 39 has a slot 41 therein which permits travel of the dead bolt therethrough and into the strike of the door (not shown).

The frame includes rectangularly shaped legs 43 and 45 which are connected by a rectangularly shaped cross member 47 to form a U-shaped structure. The legs 43 and 45 with the cross member 47 are designed to engage a door jamb (not shown) to prevent withdrawal of a dead bolt from a door strike by wedging a tool between the door and door jamb. The frame 39 maintains the dead bolt within the door strike by having the door strike positioned within the U-shaped channel formed by the legs 43 and 45 and the cross member 47. The frame 39 may be omitted from the back plate 9 such that the bottom member 13 serves to form part of the channel for dead bolt operation.

Figure 9:
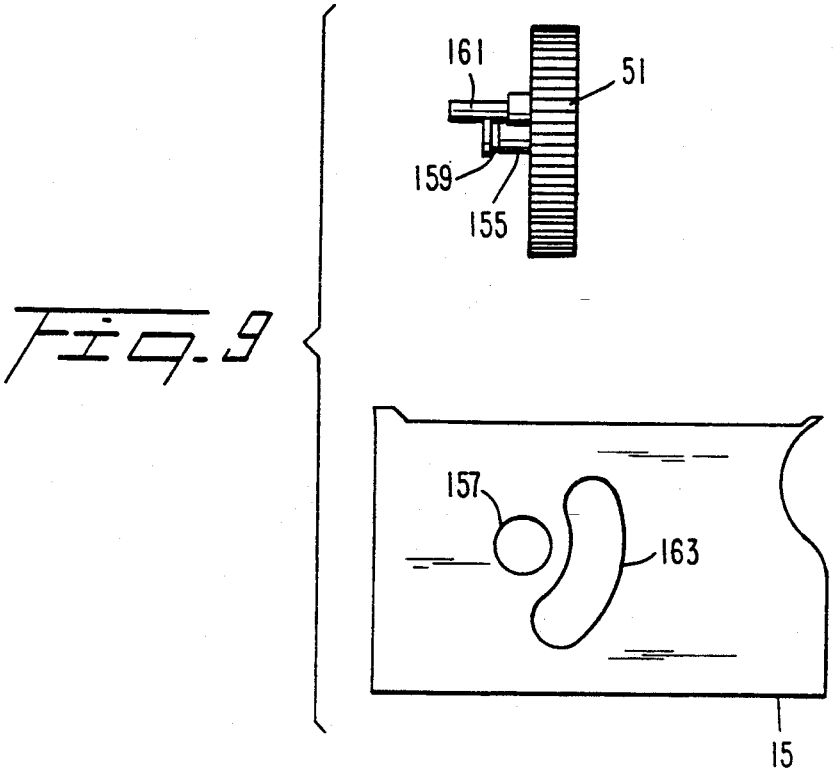
FIG. 9 shows a top view of the dead bolt assembly cover and a side view of the dead bolt turning knob.
Figure 10:
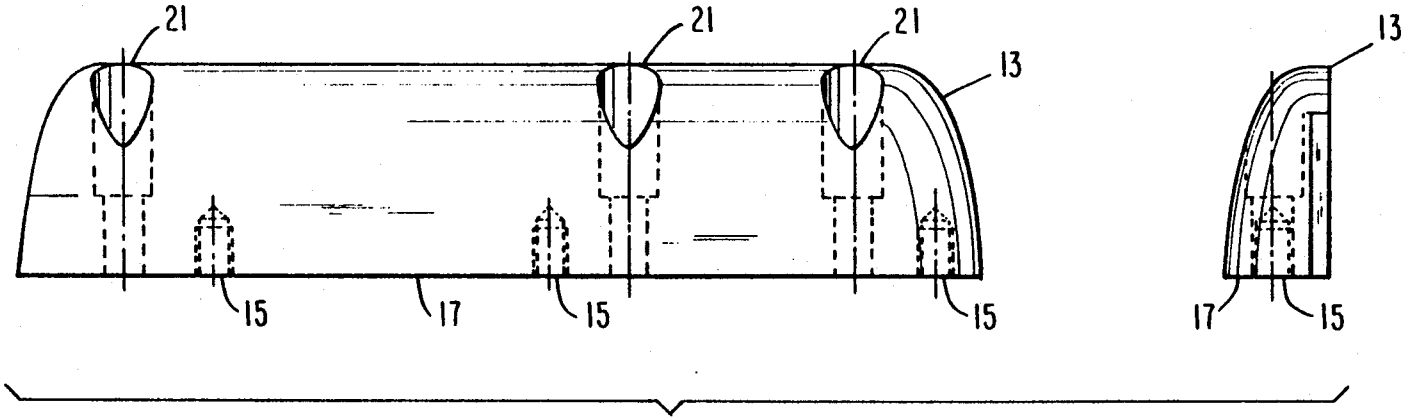
FIG. 10 shows front and side views of the bottom member of the dead bolt assembly.

With reference to FIGS. 1 and 9, the cover 15 has a dead bolt turning knob 51 extending therethrough. The operation of the dead bolt turning knob 51 will be described in greater detail hereinafter.

The cover 15 is secured in place via fasteners (not shown) extending through the openings 53 and the back plate 9, see FIG. 3*b*. The underside of the cover 15 includes threaded openings therein adapted to receive fasteners extending through the openings 53 for securing the cover in place.

With reference to FIGS. 1 and 3*a*–3*c* again, attaching the L-shaped member 11, cover 15 and bottom member 13 to the back plate 9 forms a chamber having an open top and open side for slidably receiving the combination dial lock assembly 3 therein.

The leg 25 in combination with the cover 15, back plate 9 and leg 45 or bottom member 13 if the leg 45 is omitted form a channel which houses the components of the dead bolt aspect of the inventive assembly and also provides a channel for extension and retraction of the dead bolt and dead bolt carrier of the dead bolt assembly.

Figure 7:
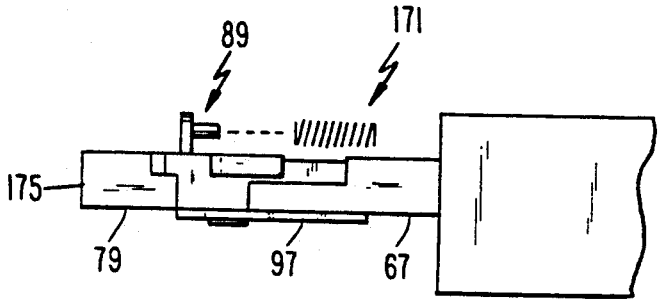
FIG. 7 shows a view along the line VII—VII depicted in FIG. 6.
Figure 8:
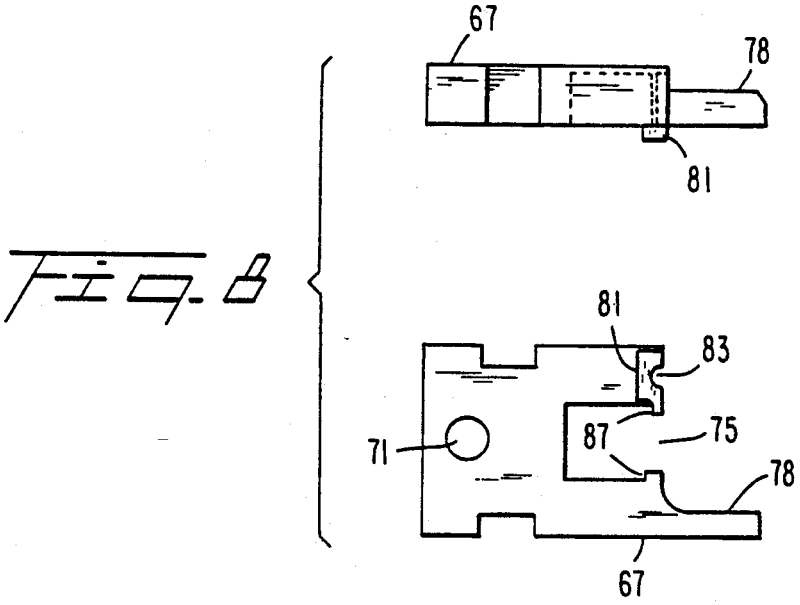
FIG. 8 shows a side front and top view of the dead bolt carrier removed from the dead bolt assembly.

With reference now to FIGS. 2, 6, 7 and 8, the inventive dead bolt assembly further includes a dead bolt carrier 67 which is connected to the combination dial lock mechanism by a screw 69 threadably engaging the opening 71 in the bolt carrier 67. Disposed between the bolt carrier 67 and screw head is a lock lever 73 which cooperates with the locking mechanism of the combination dial lock assembly 3. As stated above, any combination dial lock assembly may be used with the inventive device simply by attaching the lock lever 73 to the appropriate dead bolt carrier 67. The dead bolt carrier 67 shown in FIG. 8 is exemplary for a Sargent and Greenleaf type combination lock. However, other designs of dead bolt carriers may be required to interface with other types of locks. One skilled in the art would recognize the design changes necessary, for example notches, larger diameter connecting bores, etc., to be made to the dead bolt carrier to interface with other prior art locks.

With particular reference to FIG. 8, the bolt carrier 67 includes a slot 75, a protruding leg 78 and an insert 81 having a curved recess 83 therein. The insert 81 cooperates with the dead bolt stop in operation of the dead bolt assembly. The leg 78 acts as a guide to maintain alignment of the dead bolt assembly.

The dead bolt 79 has a stem portion 77 which is designed to slide within the slot 75 of the dead bolt carrier 67. The stem 77 has a pair of stops 85 which co-act with the stops 87 on the dead bolt carrier 67 to limit outward extension of the dead bolt 79.

The dead bolt 79 includes a pin 89 extending outwardly from a rear surface 91 of the dead bolt 79. The pin includes a head 93. As will be described hereinafter, the pin 89 engages slot 95 in the leg portion 25, see FIG. 3*a*, in preventing lockout occurrences during dead bolt operation.

Figure 2:
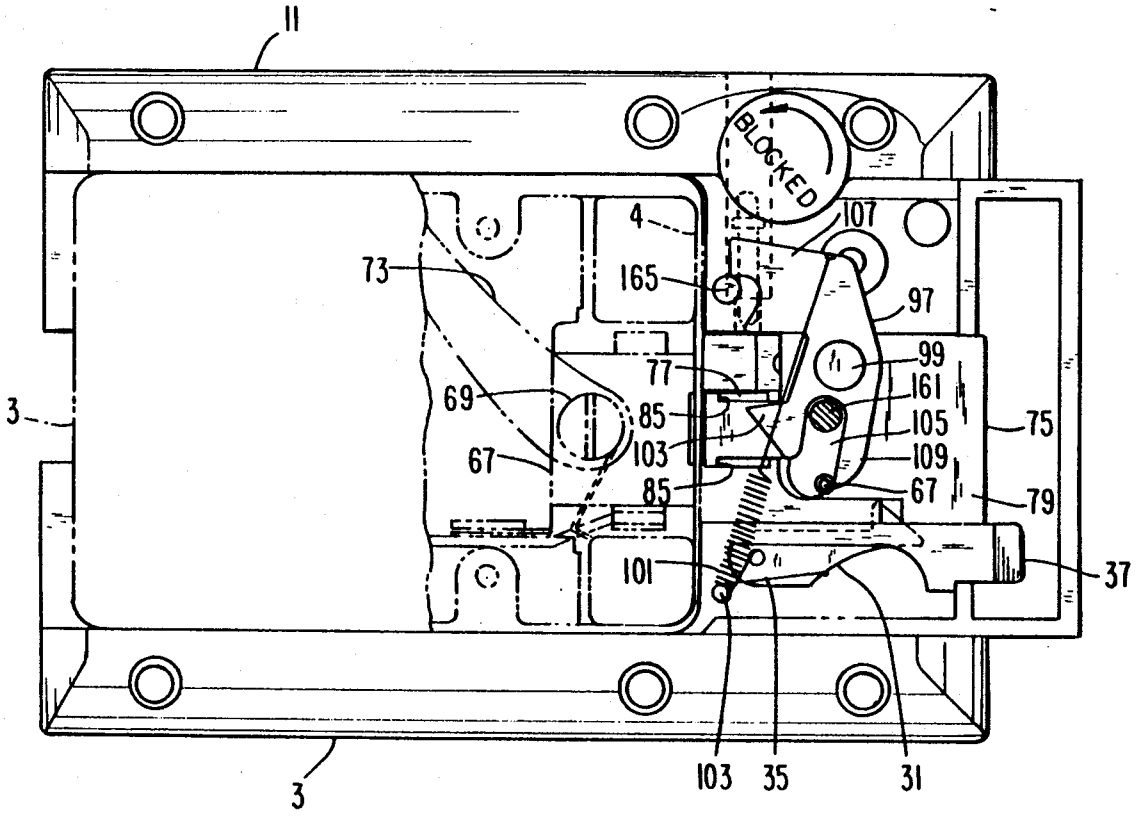
FIG. 2 shows the front view depicted in FIG. 1 with the cover removed and a portion of the combination dial lock assembly cover broken away to show greater detail.
Figure 6:
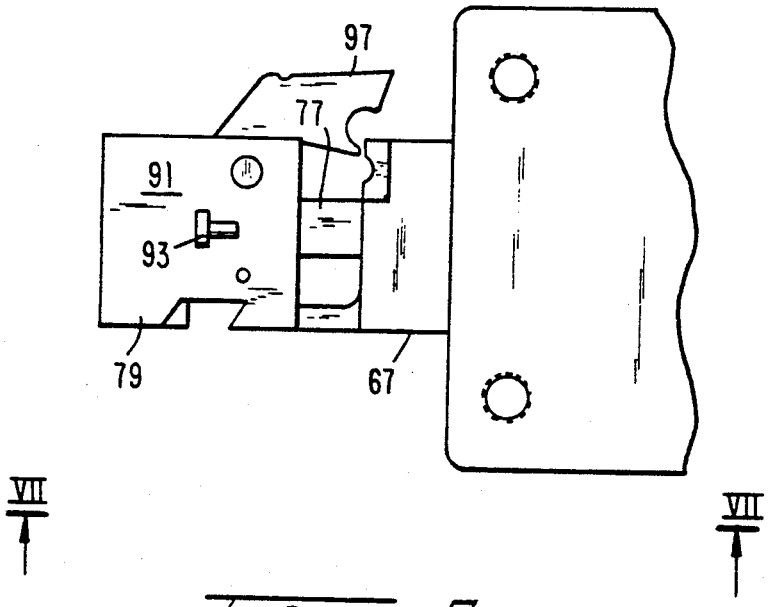
FIG. 6 shows a rear view of the dead bolt and dead bolt carrier removed from the inventive dead bolt assembly to show greater detail.

With continued reference to FIGS. 2, 6 and 7, a deadlock stop 97 is pivotally mounted on the pin 99 to the dead bolt 79. The deadlock stop 97 is spring biased downwardly via the spring 101 which is secured to the plate 9 via the pin 103. The deadlock stop 97 includes a slot 105 therein, a first ear portion 107, a second ear portion 109 and a third ear portion 103. The function of the deadlock stop in combination with the dead bolt carrier 67 and dead bolt 79 will be described hereinafter.

With reference to FIGS. 1, 4 and 4*a*–4*c*, the dead bolt assembly 10 also includes a dead bolt hold back assembly generally designated by the reference numeral 109. The dead bolt hold back assembly functions to prevent unauthorized or accidental extension of a dead bolt from the outside of a secured area. The dead bolt hold back function blocks the dead bolt carrier in a retracted position to prevent the dead bolt carrier from extending and forcing the dead bolt into the extended position.

With particular reference to FIGS. 4 and 4*a*–4*c*, the dead bolt hold back assembly includes a turning knob 111 having a knurled portion 113 and a stem 115 extending therefrom. The stem 115 has a distal end face 117 having a step 119 therein. The step 119 provides a cam surface 121.

The L-shaped member 11 includes a bore 123 therethrough. The bore 123 has a first portion 125 approximating the diameter of the stem 115 with a second enlarged diameter portion 127. The enlarged diameter portion 127 facilitates maintaining the turning knob 11 within the bore 123 while providing a chamber for the dead bolt hold back function.

Figure 4:
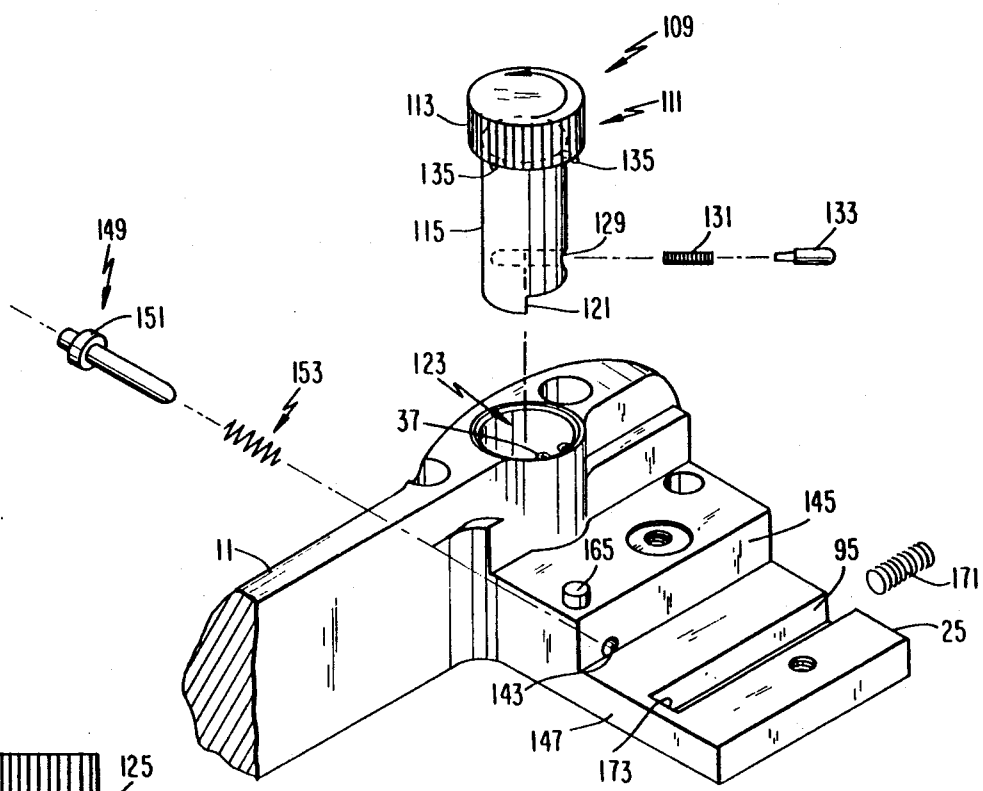
FIG. 4 shows a perspective view of a portion of the L-shaped member of the dead bolt assembly depicting the bolt hold back assembly disassembled to show components thereof.
Figure 4C:
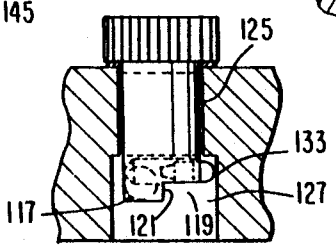
FIG. 4*c* shows another sectional view of the L-shaped member depicting the retaining pin of the turning knob of the bolt hold back assembly.

Stem 115 has an opening 129 therein which is designed to house a spring 131 and retaining pin 133. With particular reference to FIG. 4*c*, the locking pin 133 is biased outwardly by the spring 131 to prevent the turning knob 111 from being removed from the bore 123.

The stem 115 also includes a pair of stops 135 arranged beneath the knurled portion 113. Stops 135 are designed to engage opposing stops 137 arranged on a inner surface of the bore 123. The stops 135 control rotational movement of the turning knob 111.

The L-shaped member includes a bore 139 therethrough. The bore 139 is divided into an enlarged portion 141 and a reduced diameter portion 143. The reduced diameter portion 143 opens into a channel 145 formed in part by the reduced thickness portion 147 of the L-shaped member 11. A pin 149 is provided having an enlarged diameter portion 151 thereon. Moreover, a spring 153 is disposed around the pin 149 and within the enlarged diameter portion 141 of the bore 139. The spring 153 acts to upwardly bias the pin 149.

Figure 4A:
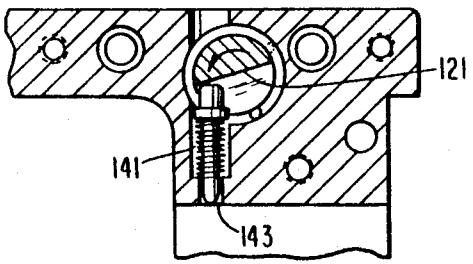
FIGS. 4*a*–4*b* show a sectional view of the L-shaped member and bolt hold back assembly depicting the bolt hold back pin extension and retraction.
Figure 4B:
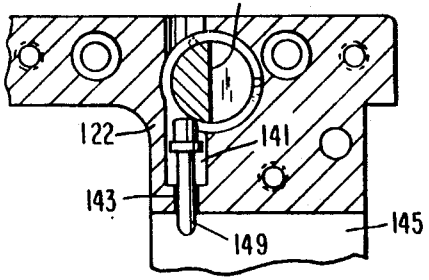

With particular reference to FIGS. 4*a* and 4*b*, in the unlocked position, the pin 149 is biased upwardly such that the pin does not extend through the opening 143. By rotation of the turning knob 111, the cam surface 121 forces the pin downwardly such that the pin extends into the slot 145, the pin contacting the outer surface 122 of the stem 115. As will be described hereinafter, the extension of the pin 149 into the slot 145 functions to prevent extension of the dead bolt into a door strike.

In another embodiment, the pin 149 is spring biased downwardly such that the pin 149 will automatically extend into the channel 145 to block the extension of the dead bolt carrier.

The interaction between the turning knob 51 in the cover 15 and the deadlock stop 97 will now be described. With reference to FIGS. 2 and 9, the turning knob 51 includes a shaft 155 extending from a rear surface thereof. The shaft 155 is designed to extend through the opening 157 in the cover 15. The shaft 155 has a slot 159 therearound which is adapted to receive a snap ring or the like (not shown) which maintains the knob 51 in place while permitting rotation of the turning knob 51 in the opening 157.

The cover 15 includes a slot 163 which controls rotational movement of the turning knob 51. The turning knob 51 includes a pin 161 extending from a rear surface of the knob and extending through the slot 163 into the slot 105 formed in the deadlock stop 97, see FIG. 2. Rotation of the turning knob 51 controls the extension in retraction of the dead bolt 79 independently from the bolt carrier 67.

Figure 5A:
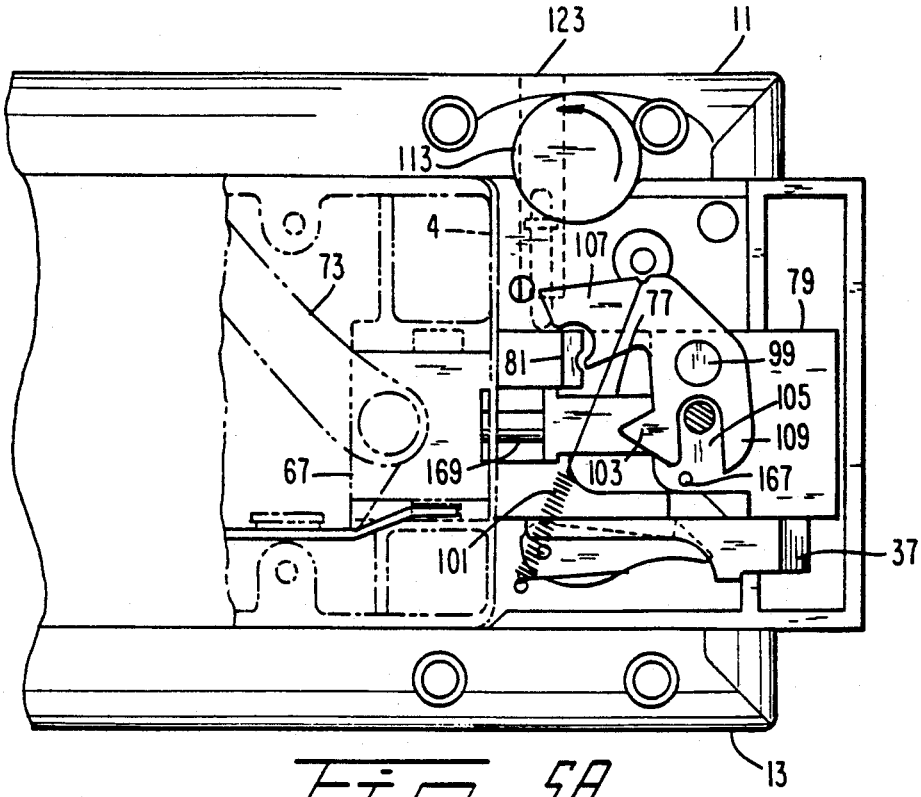
FIGS. 5*a* and 5*b* show the extension and retraction of the dead bolt assembly in cooperation with the bolt hold back assembly.
Figure 5B:
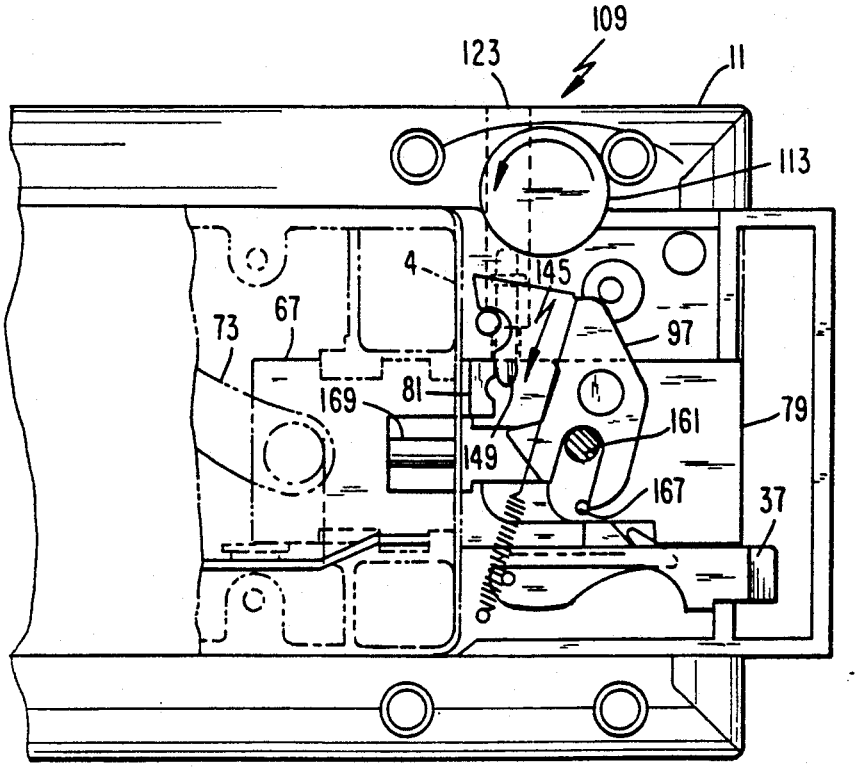

The function of the bolt hold back assembly 109 in conjunction with the dead bolt operation will now be described. With particular reference to FIGS. 2, 5*a* and 5*b*, the dead bolt 79 is shown in the retracted position in FIGS. 2 and 5*b* and the extended position in FIG. 5*a*. In FIGS. 2 and 5*a*, the dead bolt carrier is in an extended position with FIG. 5*b* showing the dead bolt carrier 67 in a retracted position. FIG. 2 illustrates the position of the dead bolt 79 when retracted by the turning knob 51. FIG. 5*a* shows the dead bolt 79 in an extended position as a result of the rotation of the turning knob 51.

FIGS. 5*a* and 5*b* illustrates the function of the dead bolt hold back assembly 109. In particular, the pin 149 is seen to extend into the channel 145 and abut against the insert 81 of the bolt carrier 67. With the pin 149 extended, the dead bolt carrier cannot extend outwardly of the lock casing 4 to force the dead bolt, as shown in the retracted position in FIG. 2, into the extended position by manipulation of the combination dial lock assembly from outside of a secured area.

With reference to FIG. 5*a*, the pin 149 is shown in the retracted position and the lock is locked. In this instance, the dead bolt can be retracted by the turning knob 51 while it is in the extended position and independent of the dead bolt carrier 67.

FIGS. 2 and 5*a* depict the dead bolt carrier in an extended position indicating that the lock lever 73 and fence (not shown) are raised from the gate (not shown) in the combination dial lock assembly. Counter-clockwise rotation of the knob 51 rotates the deadlock stop 97 as shown in FIG. 2 away from pin 165 located on the leg 25 of the L-shaped member 11, see FIG. 4, the pin 161 acting on the ear 105 of the deadlock stop 97 to retract the bolt 79 as shown in FIG. 2.

When retracting the dead bolt, counterclockwise rotation of the knob 51 pivots the deadlock stop 97 in an opposite direction such that the ear 109 thereof rests against the pin 167.

Arranged between the bolt carrier 67 and dead bolt 79 is a spring loaded shaft 169 which extends into a bore (not shown) in the stem 77 of the dead bolt 79. The spring loaded shaft 169 biases the dead bolt outwardly. The spring loading of the shaft 169 also applies a force against the dead bolt carrier 67.

In another aspect of the invention, the spring loaded shaft 169 may be replaced with a spring 171 designed to seat against the head 93 of the pin on the bolt, see FIG. 7. Alternatively, the spring associated with shaft 169 may be removed therefrom and used as spring 171. In use, a spring 171 is arranged in the slot 95, the spring end resting against the face 173, see FIG. 4. By providing a spring loaded pin arrangement in the slot 95, any force applied to the end face 175 of the dead bolt 79 will be transmitted to the L-shaped member 11 rather than the dead bolt carrier 67. In this manner, application of force against the dead bolt carrier 67 is avoided which eliminates the possibility of the lock lever 73 being hung up against the lever stop resulting in a lockout situation.

The plunger 37, as shown in FIGS. 2 and 5*a*–5*b*, is spring loaded outwardly by a spring (not shown). The plunger is designed to operate in combination with the lever 31 in a known fashion. As such, further description concerning pivoting movement of the lever 31 and extension or retraction of the plunger 37 in combination with the dead bolt 79 is not included.

It should be understood that the bolt hold back assembly 109 is only an exemplary embodiment of the present invention. Any assembly or device arranged within the housing 1 may be utilized to prevent unwanted extension of a dead bolt. For example, and as described above, when the pin 149 is biased downwardly, a key cylinder may be utilized to permit upward travel of the pin 149. In another example, a pivotally mounted lever could be used to prevent dead bolt carrier travel. The bolt hold back assembly 109 is arranged in the housing 1 to permit use of standard combination dial locks without the necessity of special components associated with the combination lock to block dead bolt travel. It should also be understood that the arrangement of the pin 89, spring 171 and slot 95 are exemplary of the manner in which application of a force against the end face of the dead bolt 79 is prevented from being transmitted to the dead bolt carrier 67. For example, the slot 95 may be configured in a different orientation or a different type of biasing device may be employed on the dead bolt 79.

As such, an invention has been disclosed in terms of preferred embodiments thereof which fulfill each and every one of the objects of the present invention as set forth hereinabove and provides a new an improved dead bolt assembly for use with a combination dial lock assembly.

Of course, various changes, modifications and alterations in the teachings of the present invention may be contemplated by those skilled in the art without departing from the intended spirit and scope thereof. As such, it is intended that the present invention only be limited by the terms of the appended claims.

I claim:

1. A dead bolt assembly for use with a combination dial lock assembly and door comprising:

a) a housing having a channel through a portion thereof, said housing forming a chamber, the chamber receiving a casing enclosing said combination dial lock assembly;

b) a dead bolt carrier and a dead bolt, a portion of said dead bolt housed by said dead bolt carrier, said dead bolt carrier being adapted to attach to a part of said combination dial lock assembly, said dead bolt carrier aligned with and engaging said dead bolt, said dead bolt carrier and dead bolt being aligned with said channel for translation between an extended position and a retracted position;

c) means for retracting said dead bolt independent of said dead bolt carrier; and d) means for preventing extension of said dead bolt carrier, said means for preventing extension mounted to said housing wherein the dead bolt assembly and the chamber permit interchangeability and ease of replacement and repair of said combination dial lock assembly.

2. The assembly of claim 1 further comprising means for sliding said combination dial lock assembly into said chamber.

3. The assembly of claim 2 wherein said means for sliding said combination dial lock assembly into said chamber comprises a back plate having a slot therein, said back plate forming a part of said housing.

4. The assembly of claim 1 wherein said housing comprises:

i) an L-shaped member having a leg portion of increased width and decreased thickness;

ii) an elongated member; and iii) a cover;

iv) wherein said L-shaped member, said cover and said elongated member are attached to said back plate to form said chamber having an open top and open side, said chamber being adapted to slidably receive said combination dial lock assembly.

5. The assembly of claim 1 wherein said means for preventing extension of said dead bolt carrier comprises:

i) an elongated member; and ii) means to extend or retract said elongated member into said channel, an extension of said elongated member preventing extension of said dead bolt carrier.

6. The assembly of claim 5 wherein said means to extend or retract said elongated member comprises:

a) a blocking knob having a cam face on a distal end thereof;

b) a bore through a portion of said housing adapted to receive said blocking knob; and c) stop means for controlling rotational movement of said blocking knob in said bore;

d) wherein rotation of said blocking knob causes said cam surface to contact said elongated member and extend said elongated member into said channel.

7. The assembly of claim 6 further comprising means for removably securing said blocking knob in said bore.

8. The assembly of claim 7 wherein said means for removably securing said blocking knob comprises:

i) an elongated diameter portion of said bore; and ii) a spring loaded pin extending from a stem of said blocking knob into said enlarged diameter portion.

9. A dead bolt assembly for use with a combination dial lock assembly having a lock lever and door comprising:

a housing having a section thereof through which a channel is formed, said housing forming a chamber, said chamber receiving a casing enclosing said combination dial lock assembly;

b) a dead bolt carrier and a dead bolt, a portion of said dead bolt housed by said dead bolt carrier, said dead bolt carrier being attached to a part of said combination dial lock assembly, said dead bolt carrier aligned with and engaged to said dead bolt, said dead bolt carrier and dead bolt being aligned with said channel for translation between an extended position and a retracted position;

c) means for retracting said dead bolt independent of said dead bolt carrier, and d) means for transmitting a force applied to an end face of said dead bolt to a portion of said housing for preventing a lockout condition of said lock lever during transmission of said force to said dead bolt carrier and said assembly part.

10. The assembly of claim 9 wherein said means for transmitting a force comprises:

a) a region of said housing adjacent said channel being formed with a slot having an open end and an opposed end face;

b) a protrusion on a face of said dead bolt, said protrusion designed to slidably engage said slot; and c) a spring disposed between said end face of said slot and said protrusion to bias said bolt toward said open end of said slot;

d) wherein said spring transmits a force applied to said end face of said dead bolt to said end face of said slot thereby preventing transmission of force to said dead bolt carrier.

11. The assembly of claim 10 wherein said housing comprises:

i) a back plate;

ii) an L-shaped member having a leg portion of increased width and decreased thickness;

iii) an elongated member; and iv) a cover;

v) wherein said L-shaped member, said cover and said elongated member are attached to said back plate to form said chamber having an open top and open side, said chamber being adapted to slidably receive said combination dial lock assembly; and vi) wherein said cover, said leg portion, a portion of said back plate and a portion of said elongated member form said channel.

12. The assembly of claim 11 wherein said leg portion of said L-shaped member includes said slot.

13. The assembly of claim 1 further comprising means for preventing said dead bolt from being removed from a door strike by a wedging action between said door and a door jamb.

14. A dead bolt assembly for use with a combination dial lock assembly and door comprising:

a) a housing having a channel through a section thereof, said housing forming a chamber, the chamber receiving a casing enclosing said combination dial lock assembly;

b) a dead bolt carrier and a dead bolt, a portion of said dead bolt housed by said dead bolt carrier, said dead bolt carrier being adapted to attach to a part of said combination dial lock assembly, said dead bolt carrier aligned with and engaging said dead bolt, said dead bolt carrier and dead bolt being aligned with said channel for translation between an extended position and a retracted position;

c) means for retracting said dead bolt independent of said dead bolt carrier;

d) means for preventing extension of said dead bolt carrier, said means for preventing extension mounted to said housing wherein the dead bolt assembly and chamber permit interchangeability and ease of replacement and repair of said combination dial lock assembly, and e) means for transmitting a force applied to an end face of said dead bolt to a portion of said housing thereby preventing a lockout condition by transmission of said force to said dead bolt carrier and said assembly part.

15. The assembly of claim 14 wherein said means for transmitting a force further comprises:

a) a region of said housing adjacent said channel being formed with a slot having an open end and an opposed end face;

b) a protrusion on a face of said dead bolt, said protrusion designed to slidably engage said slot; and c) a spring disposed between said end face of said slot and said protrusion to bias said bolt toward said open end of said slot;

d) wherein said spring transmits a force applied to said end face of said dead bolt to said end face of said slot thereby preventing transmission of force to said dead bolt carrier.

16. The assembly of claim 14 further comprising means for preventing said dead bolt from being removed from a door strike by a wedging action between said door and a door jamb.

* * * * *